United States Patent [19]

Moore

[11] 4,280,593

[45] Jul. 28, 1981

[54] DIAGONAL ELEVATOR

[76] Inventor: W. Michael Moore, 1135 Duncanwood Dr., Nashville, Tenn. 37204

[21] Appl. No.: 115,012

[22] Filed: Jan. 24, 1980

[51] Int. Cl.[3] ..... B66B 9/06

[52] U.S. Cl. ..... 187/12; 182/10; 187/26; 187/27; 187/95

[58] Field of Search ..... 187/12, 13, 14, 7, 20, 187/26, 10, 11, 95, 19, 23, 27; 182/10, 141; 414/595

[56] References Cited

U.S. PATENT DOCUMENTS 657,782 9/1900 Mabbs ..... 187/26

1,473,813 11/1923 Crispen ..... 187/12

*Primary Examiner*—Robert J. Spar

*Assistant Examiner*—Kenneth Noland

*Attorney, Agent, or Firm*—Harrington A. Lackey

[57] ABSTRACT

A diagonal elevator adapted to move in an inclined path between a lower first station and an upper second station spaced vertically and horizontally from the first station, including an elevator car guided for movement along a diagonal path between the first and second stations and hoisting cable apparatus including a traveling pulley adapted to move horizontally as the cable supporting the elevator car is moved over the traveling pulley, so that the elevator car is moved simultaneously vertically and horizontally.

7 Claims, 2 Drawing Figures

DIAGONAL ELEVATOR

BACKGROUND OF THE INVENTION

This invention relates to an elevator apparatus, and more particularly to an elevator apparatus including a car adapted to travel along a diagonal path.

Elevator systems adapted to raise and lower elevator cars along a truly vertical path are, of course, well known in the art.

Cable cars which are adapted to travel on inclined paths along the sides of mountains are also well known.

However, it is not believed that an elevator apparatus including an elevator car adapted to travel along a diagonal path within a building structure is known, much less an elevator apparatus having a hoist system which includes a horizontally traveling pulley supporting the cable to permit simultaneous horizontal, as well as vertical, movement of the elevator car.

SUMMARY OF THE INVENTION

It is therefore an object of this invention to provide an elevator which is capable of traveling horizontally as well as vertically as the hoisting cable is being wound and unwound about a driven windlass mechanism, to create a resultant inclined or diagonal path along which the elevator car moves.

More specifically, the elevator apparatus made in accordance with this invention includes an elevator car to which are secured follower members for cooperatively engaging elongated inclined guide means or guide rails disposed parallel to each other, and extending generally between a first station, such as the first floor of a building, and a horizontally and vertically displaced second station, such as the second or upper floor of the building.

The hoisting mechanism for moving the elevator car includes a cable, one end of which is connected to the elevator car and the opposite end portion of which is wound or wrapped about a windlass sheave or pulley driven by a reversible rotary motor. The cable may be trained about an idler pulley, and is trained about a traveling pulley member which is adapted to move longitudinally and horizontally along a path spanning the horizontal spacing between the first and second stations, as the cable travels over the pulley.

Thus, when the windlass mechanism is driven to raise the elevator car from the first to the second station along an inclined path, the cable is wound about the windlass sheave and moves upward over the traveling pulley. However, the movement of the cable causes rotary bearing members fixed to the pulley to roll along fixed tracks so that both the traveling pulley and the elevator car are moving horizontally, as the car is being pulled upward. Thus, the combination of these vertical and horizontal vectorial forces results in an inclined path of travel for the elevator car between the horizontally and vertically spaced first and second stations.

Since the cable is an inextensible member, every portion of the cable is traveling the same distance during the same period of time. Accordingly, as the cable is being wound, the elevator car is traveling upward a distance proportional to the distance it travels horizontally, for any given period of time. The reverse is true when the windlass mechanism unwinds the cable to lower the elevator car and causes it to move horizontally in the opposite direction.

DESCRIPTION OF THE PREFERRED EMBODIMENTS

Figure 1:
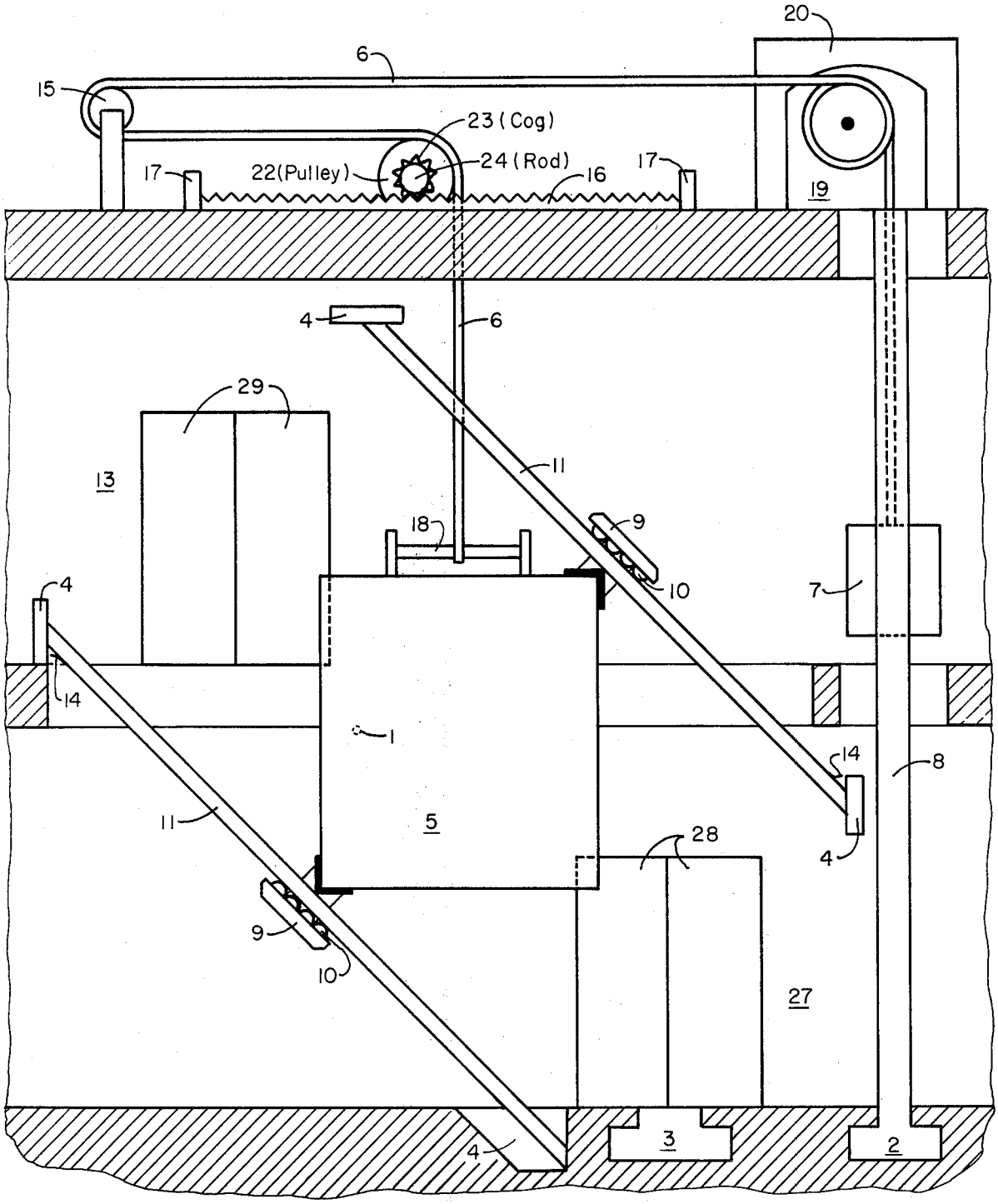
FIG. 1 is a rear elevational view of the elevator apparatus with the building structure disclosed in section and fragmentarily.

Referring now to the drawings in more detail, FIG. 1 discloses a two-story building structure in cross-section, including a first floor 27 and a second floor 13.

The elevator car 5 is adapted to travel in an inclined or diagonal path between a first station such as the elevator doors 28 on the first floor 27 and a second or upper station represented by the elevator doors 29 on the second floor or second story 13.

The elevator car 5 is provided with brackets 9 mounted on diagonally opposite, upper right and lower left, corners, each bracket 9 including a plurality of guide rollers or bearings 10. The guide rollers 10 are adapted to engage and travel along a pair of guide means, or straight, inclined guide rails 11, which are parallel to each other, but are mounted respectively above and below the respective elevator doors 28 and 29, as well as above and below the elevator car 5. The stop brackets 4 at the respective ends of the guide rails 11 are designed to limit the travel of the elevator car 5 between its lower or first station 28 and its upper or second station 29.

A cavity 3 is provided in the floor of the first story 27 below the elevator doors 28 into which a buffer or shock absorbing mechanism may be mounted to absorb the shock of the weight of the elevator car 5 coming to rest at the lower or first station.

One end of a cable 6 is fixedly secured to the top of the elevator car 5 by a cable holder 18. The cable 6 is then trained about a traveling pulley 22, an idler pulley 15, and the driven windlass sheave of the drive motor 19, about which the cable 6 is wrapped one or more turns before it terminates in a counterweight 7, supported for vertical movement between guide rails 8. A buffer space 2 may also be provided into which a buffer or shock absorber mechanism, not shown, may be placed in order to absorb the shock of the downward movement of the counterweight 7 when it reaches the first floor 27.

Figure 2:
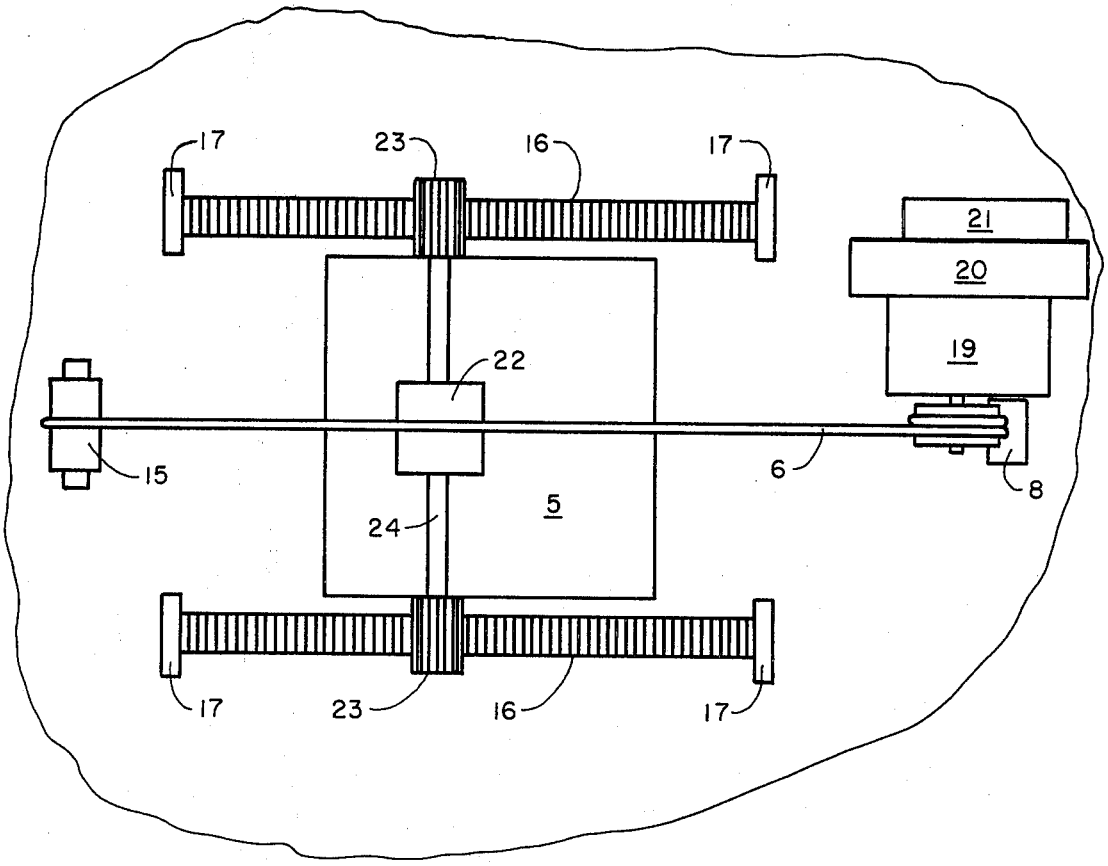
FIG. 2 is a top plan view of the elevator apparatus with the building structure shown fragmentarily.

The traveling pulley 22, disclosed in FIGS. 1 and 2, is fixed coaxially to a shaft or suspension rod 24 upon the extremities of which are fixedly mounted rotary traction wheels or bearings, such as the cogwheels having circumferentially spaced cogs or cog teeth 23. The cogs 23 engage the teeth of elongated straight horizontal racks 16 for horizontal longitudinal movement therealong. The tracks 16 have stop members 17 at each end thereof to limit the travel of the cogwheels.

The windlass motor 19 is reversible and may be controlled by the circuitry within the electrical control housing 20, in response to a start push button 1 located within the elevator car 5 for starting the drive motor 19. The control housing 20 may be supplied with electrical power from any conventional power source through the transformer 21. The drive motor 19 may also be stopped when the follower brackets 9 on the car 5 engage the respective limit switches 14 located at opposite extremities of the respective upper and lower inclined guide rails 11. These limit switches 14 are also connected, by means, not shown, to the electrical circuitry within the control housing 20.

It will be understood that the elevator car 5 could be an enclosed car, cab or capsule for transferring personnel or freight between the lower and the upper stations, or it could be a more open framework structure, even constituting a platform member.

Assuming that the elevator car 5 is used for passengers in the disclosed two-story building having elevator doors 28 on the first floor 27 and elevator doors 29 on the second floor 13, and assuming the car 5 is at rest in its first or first floor station, the doors 28 are opened and the car 5 is entered by persons desiring to travel to the second floor. A person pushes the start button 1, which energizes the controls within the housing 20 to actuate the windlass motor 19 in order to wind up the cable 6. As the cable 6 is wound, the counterweight 7 descends, while the cable 6 travels over the traveling pulley 22 and the idler pulley 15. The engagement of the cable 6 with the traveling pulley 22 causes the pulley 22 simultaneously to rotate in a counterclockwise direction, thereby rotating the suspension rod 24 and the cogs 23 in a counterclockwise direction.

Since the cogs 23 engage the teeth of the rack 16, the traveling pulley 22 is not only rotated in a counterclockwise direction, but is traveling in a straight horizontal direction to the left. Because the cable 6 is inextensible, for every foot that the cable 6 is wound about the windlass sheave, the car 5 is elevated one foot in the same period of time. Accordingly, as the car 5 is being pulled upward, it moves to the left by a distance in proportion to the ratio or diameters of the cogwheel 23 and the traveling pulley 22 in a resultant vectorial direction at an angle to the horizontal. Thus, the car 5 is traveling upward and to the left in a straight diagonal or inclined direction guided between the guide rails 11 by the follower rollers 10. This inclined motion continues until the elevator car 5 has reached the upper limit of its travel and front doors, not shown, of the elevator 5 register with the elevator doors 29 on the second story 13. Engagement of the lower follower bracket 9 with the upper limit switch 14 automatically de-actuates the controls within the housing 20 to stop the windlass motor 19, and thereby stop the car 5 in its upper position adjacent the second station. The doors are opened and the persons in the elevator 5 may then exit to the second floor.

The same procedure is carried out in reverse, to cause the elevator car 5 to return along the same path in reverse to the first station or first floor 28. When the push buttom 1 is again depressed, the motor 19 is reversed to counter-rotate the windlass sheave, thereby lowering the car 5. The traveling pulley 22 counter-rotates in a clockwise direction, simultaneously causing the pulley 22 to travel in a linear horizontal direction to the right. The car 5 will continue traveling downward and to the right until it registers with the elevator doors 28 on the first floor 27.

What is claimed is:

1. An elevator apparatus comprising:

(a) a building structure including at least first and second stations spaced from each other vertically and horizontally, (b) an elevator car, (c) inclined guide means extending generally between said first and second stations, (d) follower means on said elevator car and cooperative with said guide means for guiding the movement of said car between said first and second stations, (e) a cable member, (f) means connecting one portion of said cable member to said car, (g) windlass means for winding and unwinding another portion of said cable member, (h) track means on said structure extending a distance commensurate with the horizontal spacing of said first and second stations, (i) traveling pulley means including a pulley engaging said cable member between said connecting means and said windlass means, and rotary traction means cooperative with said track means for causing said traveling pulley means to move along said track means as said cable is wound and unwound, so that said elevator car travels in a diagonal path along said inclined guide means between said first and second stations.

2. The invention according to claim 1 in which said track means comprises a pair of spaced longitudinal track members, said rotary traction means comprises a pair of traction rollers fixed to opposite sides and coaxially of said pulley, said traction rollers rollably engaging said corresponding track members for movement along said track members as said cable member is wound and unwound.

3. The invention according to claim 2 in which said track members are straight horizontal racks and said traction rollers are cog members having teeth operatively engaging the teeth of said corresponding racks.

4. The invention according to claim 3 in which the windlass means comprises a rotary windlass sheave about which said cable member is wrapped, and means for rotatably driving said windlass sheave, said windlass means being located adjacent one end of said track members, and an idler pulley mounted on said structure adjacent the opposite end of said track members, said traveling pulley means being located between said windlass means and said idler pulley.

5. The invention according to claim 4 in which a counterweight is fixed to said cable member on the opposite side of said windlass sheave from said connecting means.

6. The invention according to claim 1 in which said inclined guide means comprise at least one inclined guide rail below said elevator car and at least one upper inclined guide rail above said elevator car and extending parallel to said lower guide rail, and stop means at the ends of said guide rails for limiting the upper movement of said elevator car to a position registering with said second station and to a lower position registering with said first station.

7. The invention according to claim 6 in which said follower means comprise guide rollers rotatably engaging said inclined guide rails.

* * * * *